US005143561A

United States Patent [19]

Kitamura et al.

[11] Patent Number: 5,143,561

[45] Date of Patent: Sep. 1, 1992

[54] METHOD OF PRODUCING GRAIN ORIENTED SILICON STEEL SHEETS HAVING IMPROVED MAGNETIC PROPERTIES AND A CONTINUOUS INTERMEDIATE ANNEALING EQUIPMENT THEREFOR

[75] Inventors: Kunio Kitamura, Chiba; Namio Suganuma; Tadashi Naito, both of Kurashiki, all of Japan

[73] Assignee: Kawasaki Steel Corporation, Japan

[21] Appl. No.: 770,712

[22] Filed: Oct. 3, 1991

Related U.S. Application Data

[63] Continuation of Ser. No. 368,323, Jun. 1, 1989, abandoned.

[30] Foreign Application Priority Data

Jul. 21, 1987 [JP] Japan ..... 62-179994

[51] Int. Cl.[5] ..... B21B 45/06

[52] U.S. Cl. ..... 148/111; 148/112; 72/40

[58] Field of Search ..... 148/111, 112; 72/39, 72/40, 366.2, 379.2

[56] References Cited

U.S. PATENT DOCUMENTS

| | | | |
|---|---|---|---|
| 3,947,296 | 3/1976 | Kumazawa | 148/111 |
| 4,123,298 | 10/1978 | Kohler et al. | 149/111 |
| 4,773,948 | 9/1988 | Nakaoka et al. | 148/111 |
| 4,872,245 | 10/1989 | Kawasaki et al. | 72/40 |
| 5,028,279 | 7/1991 | Wada et al. | 148/111 |

FOREIGN PATENT DOCUMENTS

| | | | |
|---|---|---|---|
| 2210665 | 7/1987 | France . | |
| 72720 | 5/1982 | Japan | 72/39 |
| 61-127819 | 6/1986 | Japan . | |
| 63-119925 | 5/1988 | Japan . | |
| 119925 | 5/1988 | Japan | 72/40 |

*Primary Examiner*—George Wyszomierski
*Attorney, Agent, or Firm*—Austin R. Miller

[57] ABSTRACT

This invention effectively smoothens the steel sheet surface after final cold rolling by removing oxidation scale produced on the steel sheet surface in the production steps of grain oriented silicon steel sheets, particularly after intermediate annealing and at a stage before the final cold rolling, or further forming grooves onto the steel sheet surface along the rolling direction, and hence can utilize high speed tandem rolling for the final cold rolling, whereby the production of grain oriented silicon steel sheets having excellent magnetic properties is realized in a high productivity.

6 Claims, 5 Drawing Sheets

METHOD OF PRODUCING GRAIN ORIENTED SILICON STEEL SHEETS HAVING IMPROVED MAGNETIC PROPERTIES AND A CONTINUOUS INTERMEDIATE ANNEALING EQUIPMENT THEREFOR

This application is a continuation of U.S. application Ser. No. 07/368,323, filed Jun. 1, 1989, abandoned.

TECHNICAL FIELD

This invention relates to a method of producing grain oriented silicon steel sheets having improved magnetic properties and a continuous intermediate annealing equipment therefor, and more particularly it is effective to advantageously enhance, iron loss properties by improving the surface condition of steel sheets before the final cold rolling step among production steps for the grain oriented silicon steel sheet.

BACKGROUND ART

The grain oriented silicon steel sheets are mainly used as a core for transformers and other electrical machineries, and are required to be excellent in magnetic properties, particularly magnetization property and iron loss property.

The magnetic properties of the grain oriented silicon steel sheet are strongly affected by not only the sheet quality but also its surface properties. For example, the smaller the surface roughness, the better the magnetic properties as disclosed in Japanese Patent laid open No. 59-38326.

Therefore, a rolling treatment rendering the surface roughness of the steel sheet into a center-line average roughness Ra of not more than 0.4 μm, which is called bright finishing, is adopted at the cold rolling step.

As the surface roughness or specific surface area increases, the surface enriching amount of MnS or MnSe acting as an agent inhibiting normal growth of crystal grain (inhibitor) increases to weaken the inhibitor effect inside the steel sheet in the secondary recrystallization annealing step, and consequently the growth of recrystallized grains is insufficient. Further, when the surface of the finally cold rolled steel sheet becomes rough, not only the unevenness of the surface of the product sheet is large, but also the insulating film formed on the sheet surface is thick and uneven, so that when the product sheet is magnetized, the movement of magnetic domains is obstructed.

Furthermore, when the steel sheet contains 2.5~4.0 wt % (hereinafter shown by % simply) of Si as in the grain oriented silicon steel sheet, it is very brittle and is apt to be broken as compared with ordinary steel, and also the deformation resistance is very high, so that the cold rolling is generally carried out at a low speed of not more than about 700 mpm using a reverse mill such as sendzimir mill having a small roll diameter (roll diameter: about 80 mm). Therefore, the rolling efficiency is low and the productivity is poor.

The surface roughening due to oxidation scale will be described below.

The hot rolled sheet as a base sheet for silicon steel sheet is subjected to two or more-times cold rolling through an intermediate annealing up to a sheet thickness for final product. In the intermediate annealing, oxidation scale is produced at a thickness of about 0.2~3 μm on the surface of the steel sheet. This oxidation scale consists mainly of silicon dioxide ($SiO_2$) and is very hard and acts upon the rolling roll as in abrasive grains to wear the roll surface, which is transferred to a cold rolled sheet to roughen the surface of the steel sheet.

In this connection, the applicants have previously proposed a method wherein the silicon steel sheet adhered at its surface with a scale layer after intermediate annealing is rolled in a cold tandem rolling machine line while descaling with the use of a descaling device particularly arranged between a first stand and a second stand in Japanese Patent laid open No. 63-119925 as a method for reducing the wearing of the rolling roll.

In the above method, however, there are still the following problems:

(1) The surface of the rolling roll in the first stand is roughened by the scale to shorten the life of the roll, so that roll change should frequently be made.

(2) The broken scale adheres to the surface of the roll, which is transferred to the surface of the steel sheet, resulting in the occurrence of surface defects, and hence the quality of the steel sheet is lowered.

Next, surface roughening due to the rolling lubricant will be described.

FIG. 2 is a side view diagrammatically showing clipping the steel sheet by the rolling roll. For simplification of the explanation, it is assumed that the surfaces of a roll 2 and a steel sheet 1 before rolling are smooth. In the rolling, a rolling oil is normally used for mitigating rolling load, but this example is a case of using no rolling oil. In this figure, the contact between the roll 2 and the steel sheet 1 starts from a point A. At this point A, the steel sheet 1 begins to cause plastic deformation. The steel sheet 1 and the roll 2 metallically contact each other because there is no rolling oil. Therefore, the rolling load considerably increases, and consequently rolling may be impossible.

On the contrary, FIG. 3 shows diagrammatically a steel sheet clipped into the rolling roll 2 using rolling oil. When the viscosity of the rolling oil is large and particularly the diameter of the rolling roll or the rolling speed in the tandem mill is large, the pressure of the rolling oil 3 produced in the wedge passway at the clipped portion of the rolling roll 2 reaches to the yield stress of the steel sheet 1 at a point B on the way to the point A being the contact point between the rolling roll 2 and the steel sheet 1 shown in FIG. 2.

Therefore, the steel sheet 1 is subjected to plastic deformation, but this is a free deformation in the rolling oil 3, so that unevenness is caused in the sheet. Furthermore, the rolling oil 3 enters in the clipped region, and the deformation increases to increase the unevenness. When the unevenness becomes larger than the thickness of the oil film, the oil film is broken to start contacting between the roll and the steel sheet at a point C. The convex portion of the steel sheet 1 contacted with the rolling roll 2 is flattened by the rolling roll 2, but the concave portion is not flattened because the rolling oil 3 is filled in the concave portion, and hence the concave portion is retained as it is to make the surface of the steel sheet rough.

An example of the uneven state is shown in FIG. 4. This shows a so-called three-dimensional profile obtained by measuring height direction (Z) of the unevenness while moving a probe in lengthwise direction (X) on the surface of the steel sheet by means of a surface roughness meter, further moving the probe in widthwise direction (Y) by a given position and repeating the same measurement.

The concave portion of the steel sheet through the rolling oil can be made small by reducing the viscosity of the rolling oil, which never arrives at the level of a bright sheet.

DISCLOSURE OF THE INVENTION

It is an object of the invention to advantageously solve the aforementioned problems and to provide a method of advantageously producing grain oriented silicon steel sheets which can be subjected to high speed tandem rolling without causing the degradation of surface properties and attain the improvement of productivity and the reduction of cost as well as a continuous intermediate annealing equipment suitable for direct use in the above method.

The inventors have made various studies in order to solve the above problems and found that even when the cold rolling is carried out at a high speed in a tandem mill, the steel sheet is subjected to an improving treatment for the surface state of the sheet, i.e. descaling treatment and further a groove forming treatment after the intermediate annealing and before the final cold rolling and then the cold rolling is performed, whereby the surface level of the steel sheet after the rolling can be raised to that of bright sheet, and as a result the invention has been accomplished.

That is, the invention lies in a method of producing grain oriented silicon steel sheets having improved magnetic properties by subjecting a hot rolled sheet of silicon steel containing C: 0.02~0.1% and Si: 2.5~4.0% and a small amount of an inhibitor(s) to two or more cold rollings through an intermediate annealing up to a final sheet thickness and then subjecting it to decarburization annealing and finish annealing, characterized in that final cold rolling in the cold rolling step is tandem rolling, and an improving treatment for the surface state of said steel sheet is carried out after said intermediate annealing and before said final tandem rolling.

Furthermore, the invention lies in a continuous intermediate annealing equipment for grain oriented silicon steel sheets, characterized in that a device for improving the surface of the steel sheet is arranged at a the exit side of a continuous annealing furnace.

The invention will be described in detail below.

At first, the reason why the chemical composition of the starting steel material according to the invention is limited to the above ranges will be described below.

C: 0.02~0.1%

C is an element useful not only for effectively contributing to uniformization of hot rolled and cold rolled textures but also for enhancing the alignment of Goss orientation component in the recrystallized texture in the course of repeating the cold rolling and the annealing to final sheet thickness. When the amount is less than 0.02%, the addition effect is poor, while when it exceeds 0.1%, the temperature of soluting the inhibitor such as S, Se or the like during the slab heating rises to bring about the reduction of the inhibiting force of the inhibitor due to poor solution and also the decarburization in the decarburization annealing becomes difficult. Therefore, the amount is limited to a range of 0.02~0.1%.

Si: 2.5~4.0%

Si effectively contributes to enhance the electric resistance to reduce the iron loss. When the amount is less than 2.5%, sufficient reduction of iron loss can not be expected and also a part or whole of the steel sheet is rendered into $\gamma$ transformation during the high temperature annealing to cause disorder of crystal orientation, while when it exceeds 4.0%, the cold workability is considerably degraded. Therefore, the amount is limited to a range of 2.5~4.0%.

As the inhibitor, use may be made of so-called MnS system or AlN system composed of Mn, S, Se, Sb and the like. For example, when using the MnS system, the following composition is preferable.

Mn: 0.03~0.15%, one or two of S, Se and Sb: 0.008~0.080%

Any of Mn, S, Se and Sb are useful as an inhibitor forming element. However, when these elements are outside the above range, the sufficient inhibiting effect of normal grain growth is not obtained, so that each of these elements is favorable to be added in an amount of the above range.

Further, Mo may be added in an amount of about 0.005~0.02% for preventing slab breakage during hot rolling, if necessary.

Now, molten steel adjusted to the above preferable composition is rendered into a slab through an ingot making-blooming process or a continuous casting process and then subjected to hot rolling.

Then, the hot rolled sheet is subjected to 2 or more times cold rolling through an intermediate annealing to a final sheet thickness. In the invention, the smoothening of the steel sheet surface is attained by improving the surface condition of the steel sheet after the intermediate annealing and before the final cold rolling.

That is, after the steel sheet is subjected to a surface sweeping treatment such as grinding, polishing or the like to remove oxidation scale produced onto the surface of the steel sheet during the intermediate annealing or further a shallow groove having a depth of about 1~50 μm is formed along the rolling direction of the steel sheet, preferably within an angle range of ±45° with respect to the rolling direction, the steel sheet is subjected to cold rolling, whereby a smooth surface equal to a level of the bright sheet is obtained on the surface of the steel sheet as shown in FIG. 1.

The advantage of smoothening the steel sheet surface after surface rolling by subjecting it to the sweeping treatment such as grinding, polishing or the like is believed to be due to the following reasons.

(1) the oxidation scale is effectively removed from the steel sheet surface, so that a concave portion resulting from the scale is not formed.

(2) strain is introduced into the crystal grains beneath the surface, so that any unevenness due to plastic deformation in the rolling is made finer.

(3) when the grinding or polishing is carried out along the rolling direction as shown in FIG. 5, the rolling oil escapes from the resulting fine grooves, so that the pressure of the rolling oil generated in the wedge passway at the clipped portion of the rolling roll lowers and plastic deformation based on the pressure of the rolling oil is hardly caused.

The term "sweeping of the sheet surface" used in the invention means that the steel sheet surface is ground or polished, for example, by means of a grinding or polishing tool such as a polishing belt using a polishing paper, a cylindrical polishing sleeve, a polishing nonwoven fabric, a brush containing abrasive grains therein or further a wire brush of metal wires.

Moreover, the method of improving the surface state of the steel sheet includes mechanical descaling through a tension leveler, shot blast, rolling machine or a combination thereof, a chemical descaling with hydrochloric acid, sulfuric acid or the like, and a method of performing the sweeping after the removal of oxidation scale through the mechanical descaling or the chemical descaling in addition to the aforementioned sweeping.

Further, these methods may be selected by taking equipment cost, equipment size, running cost, treating quantity and the like into consideration.

As the equipment row, the above treatment is generally carried out by arranging the surface improving device at an entrance side of the rolling machine. In the production method according to the invention, it is more advantageous to arrange the above device at a delivery side of the intermediate annealing furnace for continuously treating the steel sheet.

Because, when the surface improving device is arranged at the entrance side of the rolling machine, it should be synchronized with the high rolling speed, so that not only the device is made large but also the control is difficult. On the other hand, when it is arranged at the delivery side of the intermediate annealing furnace, the sheet passing speed is fairly low, so that the device is made small and the control is easy.

In FIG. 6 is schematically shown a preferable embodiment of the continuous intermediate annealing equipment according to the invention.

Numerals 10*a* and 10*b* are entrance side and delivery side loopers, 11*a*, 11*b* and 11*c* bridle rolls, respectively, and 12 a continuous annealing furnace which is comprised of a heating zone 12-a, a soaking zone 12-b and a cooling zone 12-c. And also, 13 is a device for improving the steel sheet surface. The steel sheet surface after the intermediate annealing is improved by the steel sheet surface improving device arranged at the delivery side of the continuous annealing furnace 12.

Further, when the surface improved steel sheet is subjected to a final cold rolling, it is more advantageous that the roughness of the rolling roll in at least final pass is not more than 0.30 μm Ra and the viscosity at 50° C. of the rolling oil is 2~15 cSt in order to obtain such a smooth surface that the roughness of the sheet surface after the rolling is not more than 0.4 μm Ra.

That is, in oil lubrication rolling, the rolling oil is usually supplied to a sheet or a roll as an emulsion obtained by emulsifying and suspending oil particles into water to extend the oil in the emulsion over the sheet surface and drawn into a wedge-like portion defined by the sheet and the roll at the entrance side of roll bite through a hydrodynamics effect (so-called wedge effect) to enter into the roll bite, whereby a concave portion is formed on the steel sheet. If the roughness of the rolling roll exceeds 0.30 μm Ra, there is largely caused a fear that the roughness of the sheet surface becomes larger than 0.4 μm due to the unevenness based on the transcription of the roughness of the rolling roll and the concave portion resulted from the rolling oil, while if the viscosity of the rolling oil at 50° C. exceeds 15 cSt, the roughness of the sheet surface is apt to become larger than 0.4 μm when high speed rolling is carried out a tandem rolling machine having a rolling roll diameter of about 600 mm.

BEST MODE OF CARRYING OUT THE INVENTION

EXAMPLE 1

Figure 1:
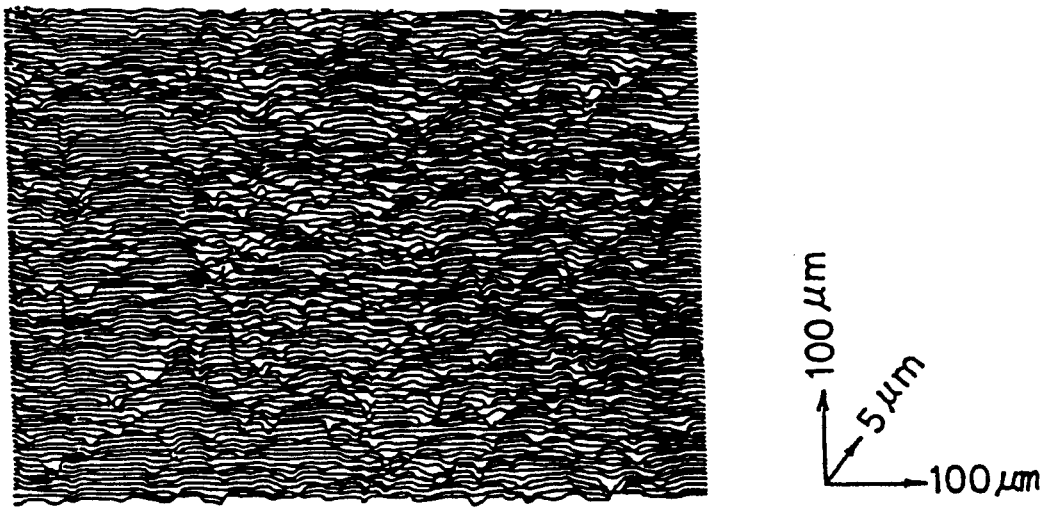
FIG. 1 is a chart showing a three-dimensional profile of a cold rolled silicon steel sheet subjected to a final cold tandem rolling after the surface improving treatment according to the invention.
Figure 2:
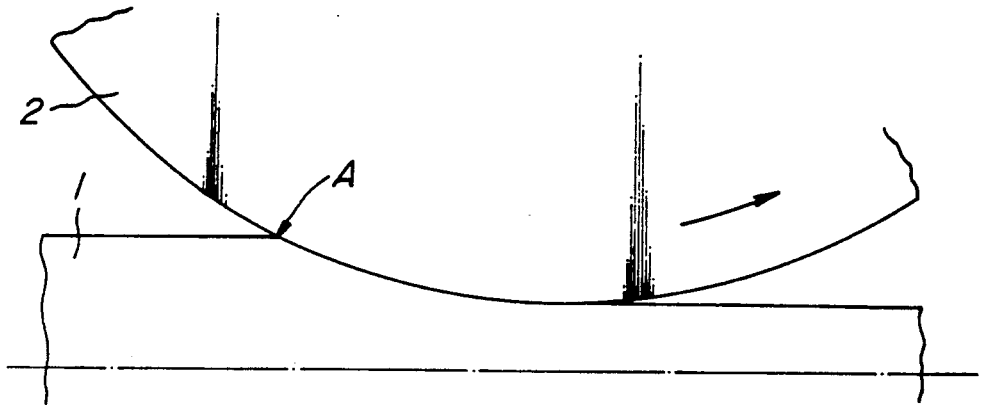
FIGS. 2 and 3 are side views schematically showing a clipped state of the steel sheet by the rolling roll, respectively.
Figure 3:
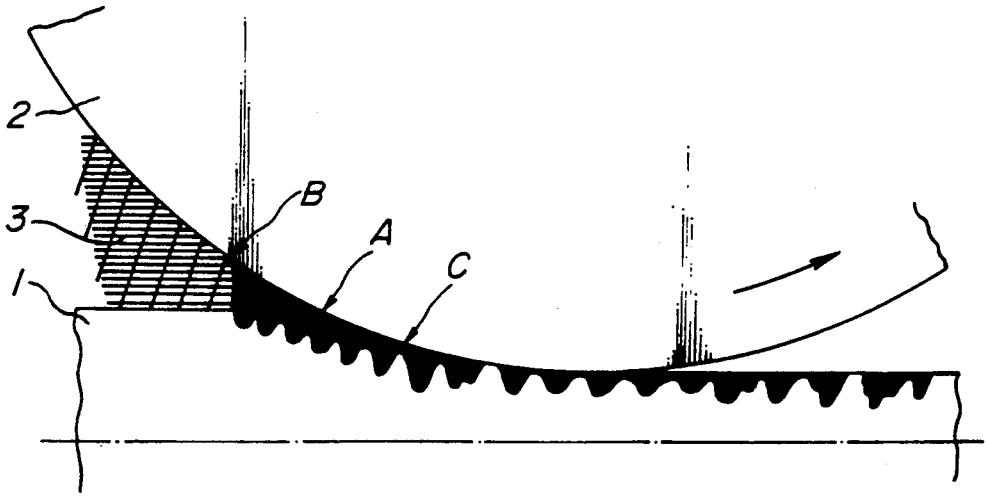
Figure 4:
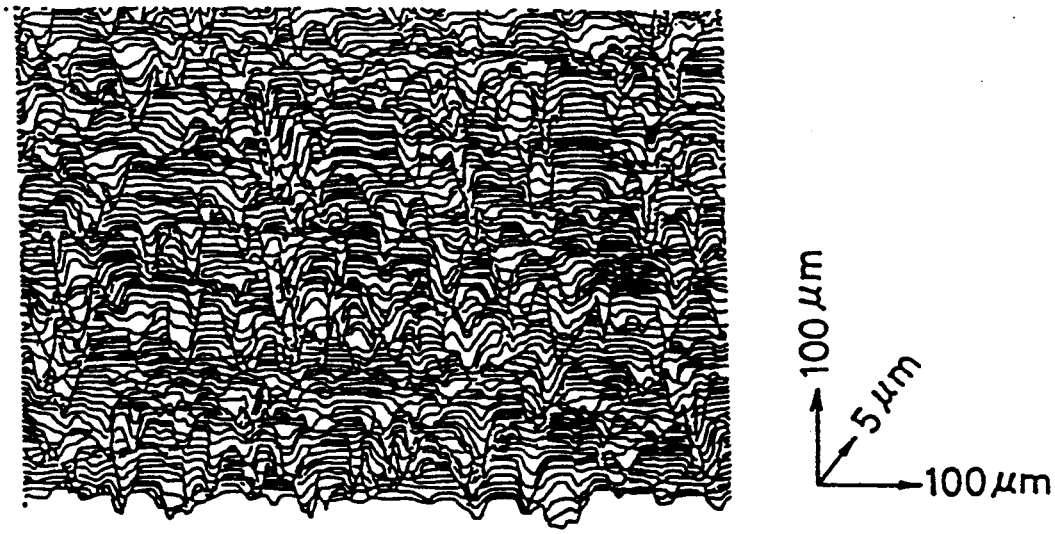
FIG. 4 is a chart showing a three-dimensional profile of a cold rolled silicon steel sheet after the cold rolling according to the conventional method.
Figure 5:
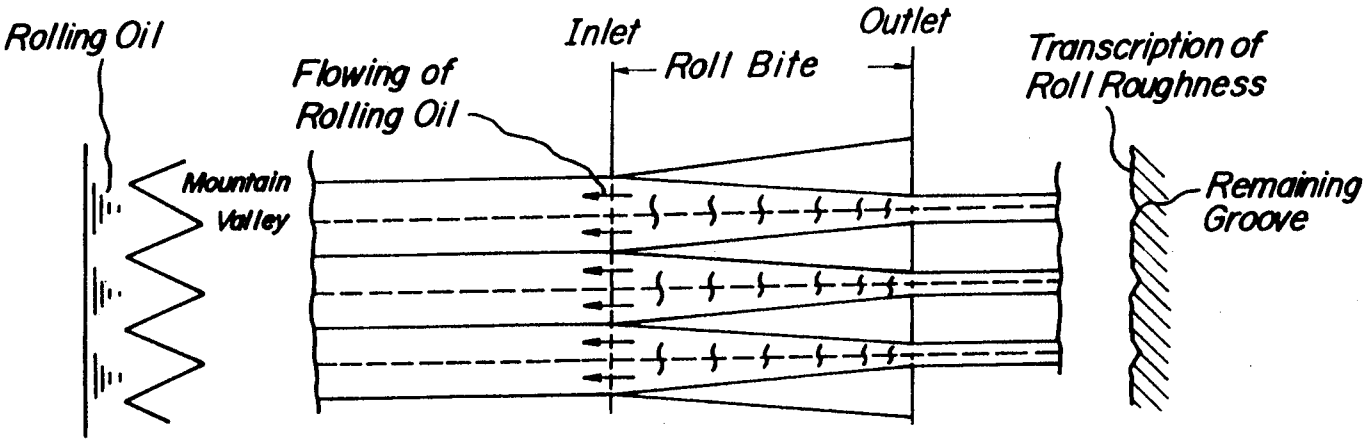
FIG. 5 is a view illustrating a flowing state of a rolling oil when the steel sheet provided at its surface with fine grooves is subjected to a rolling.
Figure 6:
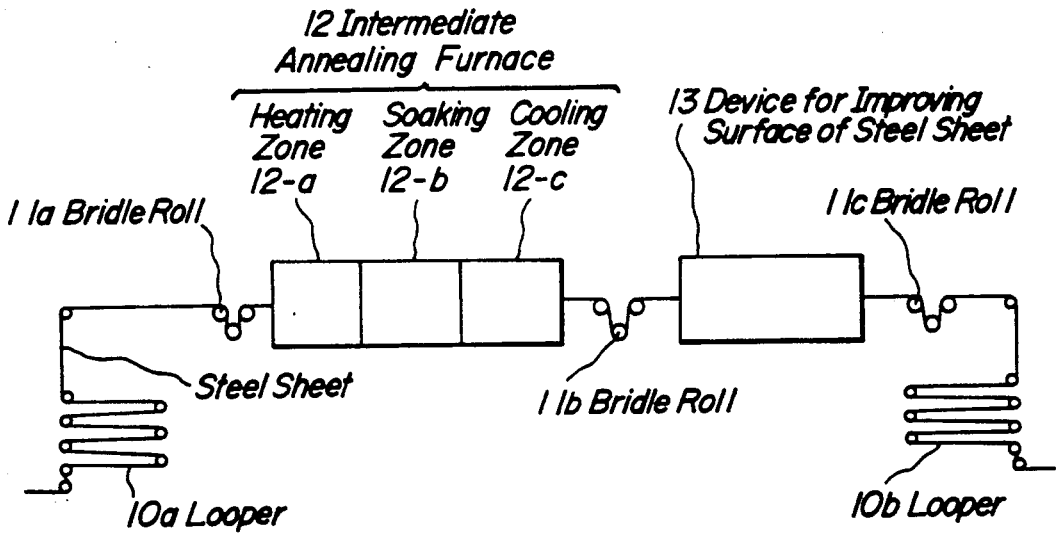
FIG. 6 is a schematic view of a preferable embodiment of the continuous intermediate annealing equipment according to the invention.

A hot rolled sheet of silicon steel containing C: 0.045%, Si: 3.35%, Mn: 0.065%, Se: 0.017% and Sb: 0.027% and having a thickness of 2.5 mm was subjected to a normalized annealing at 1000° C. for 30 seconds, pickled, cold rolled to 0.64 mm, and subjected to an intermediate annealing at 980° C. for 90 seconds to prepare three samples A, B and C. Thereafter, the sample A was ground at its surface in parallel to the rolling direction with a polishing belt of grain size #100, while the sample B was ground with the similar polishing belt in a direction perpendicular to the rolling direction as an invention example. Further, the intermediately annealed sample C was used as a comparative example.

Each of these samples was finished to a final sheet thickness of 0.23 mm in a 3-stand tandem mill provided with a rolling roll having a roll diameter of 350 mm and a roll surface roughness of 0.1 μm Ra at a final stand rolling speed of 1000 mpm with the use of a rolling oil having a viscosity of 8 cSt/50° C. and a concentration of 3%. After the surface average roughness (Ra) of the portion rolled at a rolling speed of 1000 mpm was measured, each of these samples was subjected to decarburization annealing, coated with an annealing separator, and then subjected to a finish annealing at 860° C. for 60 hours and at 1200° C. for 5 hours.

The iron loss ($W_{17/50}$) and magnetic flux density ($B_{10}$) of the thus Obtained grain oriented silicon steel sheets were measured to Obtain results as shown in Table 1.

TABLE 1

| Classification | Sample | Average surface roughness Ra (μm) | $W_{17/50}$ (W/kg) | $B_{10}$ (T) |
|---|---|---|---|---|
| Invention Example | A | 0.20 | 0.83 | 1.923 |
| | B | 0.25 | 0.84 | 1.921 |
| Comparative Example | C | 0.55 | 0.90 | 1.900 |

As seen from Table 1, the samples A and B obtained according to the invention are very excellent in not only the surface properties but also the magnetic properties as compared with the sample C as a comparative example.

EXAMPLE 2

A hot rolled sheet of silicon steel containing C: 0.038%, Si: 3.05%, Mn: 0.070% and S: 0.020% and having a thickness of 2.7 mm was pickled, cold rolled to 0.74 mm, and subjected to an intermediate annealing at 970° C. for 40 seconds to prepare three samples D, E and F. Thereafter, as described in Example 1, the sample D was polished at its surface with a brush containing abrasive grains of grain size #240 in parallel to the rolling direction, and the sample E was polished with a similar brush in a direction perpendicular to the rolling direction as an invention example. Further, the intermediately annealed sample F was used as a comparative example.

Each of these samples was finished to a final sheet thickness of 0.27 mm in the same 3-stand tandem mill as in Example 1 at a final stand rolling speed of 1700 mpm with the use of a rolling oil having a viscosity of 15 cSt/50° C. and a concentration of 3%. After the surface average roughness (Ra) of the portion rolled at the rolling speed of 1700 mpm was measured, each of these samples was subjected to decarburization annealing, coated with an annealing separator and then subjected to a finish annealing at 860° C. for 60 hours and at 1200° C. for 5 hours.

The iron loss ($W_{17/50}$) and magnetic flux density ($B_{10}$) of the thus obtained grain oriented silicon steel sheets were measured to obtain results as shown in Table 2.

TABLE 2

| Classification | Sample | Average surface roughness Ra (μm) | $W_{17/50}$ (W/kg) | $B_{10}$ (T) |
|---|---|---|---|---|
| Invention Example | D | 0.25 | 1.16 | 1.883 |
| | E | 0.32 | 1.17 | 1.879 |
| Comparative Example | F | 0.60 | 1.21 | 1.862 |

As seen from Table 2, the samples D and E according to the invention are very excellent in not only the surface properties but also the magnetic properties as compared with the sample F as a comparative example.

EXAMPLE 3

A hot rolled sheet containing C: 0.050%, Si: 3.10%, S: 0.027% and acid soluble Al: 0.030% was subjected to a normalized annealing at 1170° C. for 90 seconds, cold rolled to a sheet thickness of 0.3 mm, and then subjected to an intermediate annealing at 980° C. for 60 seconds to prepare three samples G, H and I. Thereafter, as described in Example 1, the sample G was polished with a brush containing abrasive grains of grain size #240 in parallel to the rolling direction, and the sample H was polished with a similar brush in a direction perpendicular to the rolling direction as an invention example. Further, the intermediately annealed sample I was used as a comparative example.

Each of these samples was finished to a final sheet thickness of 0.27 mm in the same 3-stand tandem mill as in Example 1 at a final stand rolling speed of 1700 mpm with the use of a rolling oil having a viscosity of 15 cSt/50° C. and a concentration of 3%. After the surface average roughness of the portion rolled at the rolling speed of 1700 mpm was measured, each of these samples was subjected to decarburization annealing, coated with an annealing separator and then subjected to a finish annealing at 860° C. for 60 hours and at 1200° C. for 5 hours.

The iron loss ($W_{17/50}$) and magnetic flux density ($B_{10}$) of the thus obtained grain oriented silicon steel sheets were measured to obtain results as shown in Table 3.

TABLE 3

| Classification | Sample | Average surface roughness Ra (μm) | $W_{17/50}$ (W/kg) | $B_{10}$ (T) |
|---|---|---|---|---|
| Invention Example | G | 0.24 | 0.97 | 1.942 |
| | H | 0.31 | 0.98 | 1.944 |
| Comparative Example | I | 0.60 | 1.05 | 1.920 |

As seen from Table 3, the samples G and H according to the invention are very excellent in not only the surface properties but also the magnetic properties as compared with the sample I as a comparative example.

EXAMPLE 4

A hot rolled sheet of silicon steel containing C: 0.045%, Si: 3.35%, Mn: 0.065%, Se: 0.017% and Sb: 0.027% and having a thickness of 2.5 mm was subjected to a normalized annealing at 1000° C. for 30 seconds, pickled, cold rolled to 0.64 mm and then subjected to an intermediate annealing at 900° C. for 90 seconds to prepare eight samples J, K. L, M, N, O, P and Q. Thereafter, in the samples J, P and Q, the scale was broken by a tension leveler and swept out by an elastic grinding roll of grain size #240, and the sample K was pickled with hydrochloric acid and subjected to a sweeping with the similar elastic grinding roll, and the sample L was pickled with hydrochloric acid, and the sample M was subjected to a mechanical descaling through shot blast, and the sample N was subjected to a shot blasting and then pickled with sulfuric acid. The sample O was left after the intermediate annealing. Then, each of these samples J~O was finished to a final sheet thickness of 0.23 mm in a final stand rolling mill having a roll diameter of 600 mm, and a roll roughness of 0.1 μm Ra at a final stand rolling speed of 1000 mpm and a reduction ratio of 20% with the use of a rolling oil having a viscosity of 2 cSt/50° C. and a concentration of 3%.

Further, the sample P was finished to a final sheet thickness of 0.23 mm in a final stand rolling mill having a roll diameter of 600 mm, and a roll roughness of 0.1 μm Ra at a final stand rolling speed of 1000 mpm and a reduction ratio of 20% with the use of a rolling oil having a viscosity of 20 cSt/50° C. and a concentration of 3%.

Moreover, the sample Q was finished to a final sheet thickness of 0.23 mm in a final stand rolling mill having a roll diameter of 600 mm, and a roll roughness of 0.4 μm Ra at a final stand rolling speed of 1000 mpm and a reduction ratio of 20% with the use of a rolling oil having a viscosity of 2 cSt/50° C. and a concentration of 3%.

After the surface average roughness Ra of the portion rolled at the rolling speed of 1000 mpm was measured, each of these samples was subjected to decarburization annealing, coated with an annealing separator, and then subjected to a finish annealing at 860° C. for 60 hours and at 1200° C. for 5 hours.

The iron loss ($W_{17/50}$) and magnetic flux density ($B_{10}$) Of the thus obtained grain oriented silicon steel sheets were measured to obtain results as shown in Table 4.

TABLE 4

| Classification | Sample | Average surface roughness Ra (μm) | $W_{17/50}$ (W/kg) | $B_{10}$ (T) |
|---|---|---|---|---|
| Invention Example | J | 0.15 | 0.82 | 1.925 |
| | K | 0.15 | 0.82 | 1.925 |
| | L | 0.16 | 0.825 | 1.924 |

TABLE 4-continued

| Classification | Sample | Average surface roughness Ra (μm) | $W_{17/50}$ (W/kg) | $B_{10}$ (T) |
|---|---|---|---|---|
| | M | 0.16 | 0.825 | 1.924 |
| | N | 0.16 | 0.825 | 1.924 |
| Comparative Example | O | 0.55 | 0.90 | 1.900 |
| | P | 0.60 | 0.95 | 1.880 |
| | Q | 0.50 | 0.85 | 1.920 |

INDUSTRIAL APPLICABILITY

According to the invention, even when the grain oriented silicon steel sheets are rolled at a high speed in a tandem mill having a large roll diameter, the good surface state having a surface average roughness of not more than 0.4 μm can be maintained, and hence grain oriented silicon steel sheets having excellent magnetic properties can be obtained in a high productivity.

We claim:

1. A method of producing grain oriented silicon steel sheets having improved magnetic properties by subjecting a hot rolled sheet of silicon steel containing C: 0.02~0.1% and Si: 2.1~4.0% and a small amount of an inhibitor(s) to two or more cold rollings with an intermediate annealing therebetween, to achieve a final sheet thickness, and then subjecting it to decarburization annealing and finish annealing, wherein the final cold rolling in the cold rolling step is a tandem rolling, and incl. the steps of smoothening the surface of said steel shaft and forming grooves along the rolling direction of said steel sheet after said intermediate annealing and before said final rolling.

2. The method of producing grain oriented silicon steel sheets having improved magnetic properties according to claim 1, wherein said smoothening and groove forming are carried out by sweeping on the sheet surface.

3. The method of producing grain oriented silicon steel sheets having improved magnetic properties according to claim 1, wherein said smoothening and groove forming are carried out by mechanical descaling.

4. The method of producing grain oriented silicon steel sheets having improved magnetic properties according to claim 1, wherein said smoothening and groove forming are carried out by descaling and subsequent sweeping on the sheet surface.

5. In a method of producing grain oriented silicon steel sheets having improved magnetic properties containing C: 0.02~0.1% and Si: 2.5~4.0% and a small amount of an inhibitor(s), the steps comprising in the following order:

subjecting said steel sheet to a hot rolling treatment;
annealing said hot rolled steel sheet;
subjecting said steel sheet to a first cold rolling treatment;
intermediate annealing said steel sheet;
smoothening the surface of said steel sheet;
subjecting said steel sheet to a tandem cold rolling treatment;
decarburization annealing said steel sheet; and
finish annealing said steel sheet.

6. The method of producing grain oriented silicon steel sheets having improved magnetic properties according to claim 5 further comprising the step of pickling said steel sheet before said first cold rolling step.

* * * * *

UNITED STATES PATENT AND TRADEMARK OFFICE

CERTIFICATE OF CORRECTION

PATENT NO. : 5,143,561

DATED : September 1, 1992

INVENTOR(S) : Kunio Kitamura et al

It is certified that error appears in the above-identified patent and that said Letters Patent is hereby corrected as shown below:

Column 9, line 26, please change "2.1" to --2.5--.

Signed and Sealed this

Twenty-fifth Day of January, 1994

Bruce Lehman

*Attest:*

BRUCE LEHMAN

*Attesting Officer*

*Commissioner of Patents and Trademarks*